US009090112B2

(12) United States Patent
Sakuma et al.

(10) Patent No.: US 9,090,112 B2
(45) Date of Patent: Jul. 28, 2015

(54) LIQUID DISCHARGE DEVICE AND CLEANING METHOD FOR LIQUID DISCHARGE HEAD

(71) Applicant: CANON KABUSHIKI KAISHA, Tokyo (JP)

(72) Inventors: Sadayoshi Sakuma, Yokohama (JP); Ichiro Saito, Yokohama (JP); Maki Kato, Fuchu (JP); Yuzuru Ishida, Yokohama (JP); Kenji Takahashi, Yokohama (JP); Norihiro Yoshinari, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/169,576

(22) Filed: Jan. 31, 2014

(65) Prior Publication Data

US 2014/0218439 A1 Aug. 7, 2014

(30) Foreign Application Priority Data

Feb. 1, 2013 (JP) ..... 2013-018510

(51) Int. Cl.

| | |
|---|---|
| ***B41J 29/393*** | (2006.01) |
| ***B41J 2/165*** | (2006.01) |
| ***B41J 29/17*** | (2006.01) |
| ***B41J 2/14*** | (2006.01) |

(52) U.S. Cl.

CPC ..... *B41J 29/17* (2013.01); *B41J 2/14129* (2013.01); *B41J 2/16511* (2013.01); *B41J 2/16532* (2013.01)

(58) Field of Classification Search

CPC ..... B41J 2/16505
USPC ..... 347/29–30, 19
See application file for complete search history.

(56) References Cited

U.S. PATENT DOCUMENTS

| | | | | |
|---|---|---|---|---|
| 5,440,330 | A * | 8/1995 | Anderson et al. | 347/26 |
| 2009/0213168 | A1* | 8/2009 | Ito | 347/19 |
| 2011/0102506 | A1* | 5/2011 | Yamada et al. | 347/37 |
| 2013/0141494 | A1* | 6/2013 | Ishida et al. | 347/64 |

FOREIGN PATENT DOCUMENTS

JP 2008-105364 A 5/2008

* cited by examiner

*Primary Examiner* — Jason Uhlenhake
(74) *Attorney, Agent, or Firm* — Canon USA Inc. IP Division

(57) ABSTRACT

A liquid discharge device includes a liquid discharge head including a discharge port surface on which discharge ports for discharging liquid are formed, an electrothermal conversion element configured to generate energy for discharging liquid from the discharge ports, and a protection film configured to cover at least the electrothermal conversion element, and a cap configured to cover the discharge port surface, wherein the cap is arranged along the discharge port surface at a position opposite to the protection film via the discharge ports in a state where the cap covers the discharge port surface, and wherein the cap includes an electrode configured to be used to apply voltage between the protection film and the electrode.

14 Claims, 13 Drawing Sheets

LIQUID DISCHARGE DEVICE AND CLEANING METHOD FOR LIQUID DISCHARGE HEAD

BACKGROUND OF THE INVENTION

1. Field of the Invention

The present invention relates to a liquid discharge device that discharges liquid for recording on a recording medium and a cleaning method for a liquid discharge head that discharges liquid.

2. Description of the Related Art

An inkjet head, which is a typical liquid discharge head, includes a plurality of discharge ports from which ink is discharged, flow paths each communicating to a discharge port, and an electrothermal conversion element that generates thermal energy used for discharging ink. The electrothermal conversion element is configured by a heat resistor and an electrode that supplies power to the heat resistor. Covering the electrothermal conversion element with an insulating protection layer having electric insulation ensures insulation between ink and the electrothermal conversion element. The electrothermal conversion element generates thermal energy by being driven. The generated thermal energy quickly heats a contact portion (heat-acting unit) with the ink above the electrothermal conversion element to generate foams, thus causing ink to be discharged.

The heat-acting unit of the inkjet head is heated to a high temperature by the heat of the heat resistor. At the same time, the heat-acting unit is subjected to a physical action, such as an impact by cavitation that occurs as the ink is foamed and foams are shrunk, or to a chemical action caused by the ink. To protect the electrothermal conversion element from these effects, an upper protection layer is provided on the electrothermal conversion element. The upper protection layer is made of metallic materials, such as Ta or the platinum group (Ir, Ru), which are relatively proof against an impact by cavitation and chemical action caused by ink.

At the heat-acting unit, which is a contact portion with the ink, additives included in the ink, such as color materials, are heated to a high temperature and are decomposed and changed into a hard-dissoluble substance. This results in a phenomenon in which the substance is physically adhered to the surface of the upper protection layer that configures the heat-acting unit. This phenomenon is called kogation. As described above, when kogation adheres to the heat-acting unit of the upper protection layer, heat conduction from the heat-acting unit to the ink becomes uneven. This uneven thermal conduction makes foaming unstable, sometimes affecting the discharge characteristics of ink.

Japanese Patent Application Laid-Open No. 2008-105364 discusses a method for solving this issue. According to the method, an upper protection layer is provided that acts as an electrode for generating an electrochemical reaction with the ink and, by an electrochemical reaction, the surface of the upper protection layer is eluted into ink to remove kogation on the heat-acting unit.

FIG. 6A is a schematic diagram illustrating the configuration discussed in Japanese Patent Application Laid-Open No. 2008-105364. An upper protection layer 1107*a* is formed on an electrothermal conversion element 1117 provided on an inkjet head substrate 1100. This upper protection layer 1107*a* is exposed in an ink flow path 1110. Voltage is applied in such a way that the upper protection layer 1107*a* becomes the anode electrode, and an electrode 1107*b* provided on the same surface on which the upper protection layer 1107*a* is provided becomes the cathode electrode. Applying the voltage as described above generates an electrochemical reaction between the upper protection layer 1107*a* and the ink to remove kogation on the upper protection layer 1107*a*.

SUMMARY OF THE INVENTION

According to an aspect of the present invention, a liquid discharge device includes a liquid discharge head including a discharge port surface on which discharge ports for discharging liquid are formed, an electrothermal conversion element configured to generate energy for discharging liquid from the discharge ports, and a protection film configured to cover at least the electrothermal conversion element, and a cap configured to cover the discharge port surface, wherein the cap is arranged along the discharge port surface at a position opposite to the protection film via the discharge ports in a state where the cap covers the discharge port surface, and wherein the cap includes an electrode configured to be used to apply voltage between the protection film and the electrode.

Further features of the present invention will become apparent from the following description of exemplary embodiments with reference to the attached drawings.

BRIEF DESCRIPTION OF THE DRAWINGS

FIG. 4A and FIG. 4B are diagrams illustrating a vicinity of the heat-acting unit of the inkjet head according to the exemplary embodiment of the present invention wherein FIG. 4A is a plan view and FIG. 4B is a schematic cross sectional diagram.

DESCRIPTION OF THE EMBODIMENTS

Figure 6A:
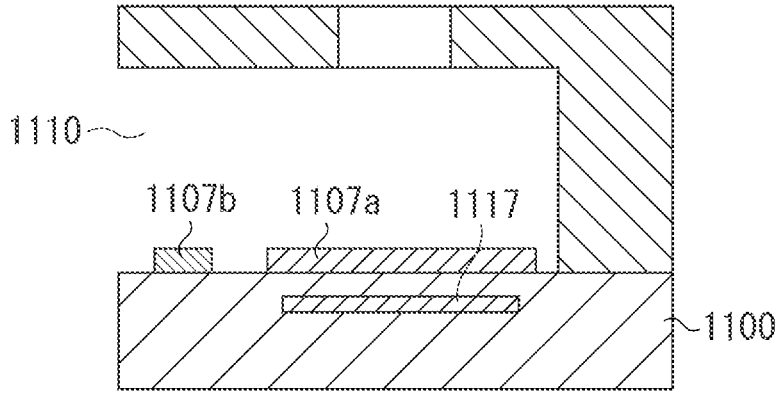
FIGS. 6A and 6B are schematic diagrams illustrating the electrode arrangement for conventional kogation removal processing, and the state after the kogation removal processing is performed, respectively.
Figure 6B:
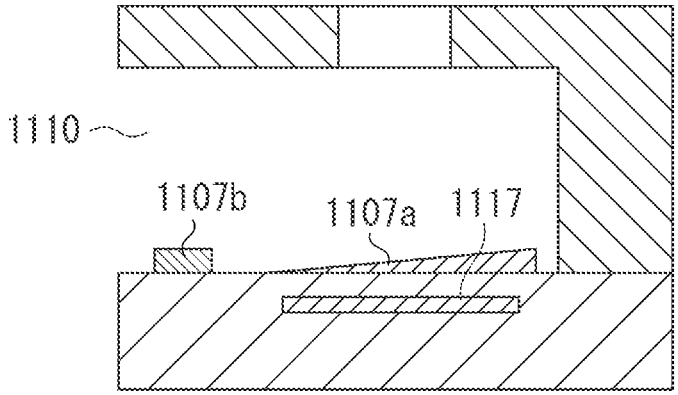

FIG. 6B is a diagram illustrating the state after kogation is removed repeatedly with the configuration illustrated in FIG. 6A.

As illustrated in FIG. 6A, when both electrodes are provided on the same surface, electric field intensity becomes large at the inside between the two electrodes and the electric field intensity becomes small at the outside of the two electrodes. With the above-described configuration, a dissolution amount of the upper protection layer 1107*a* is large on the side closer to the electrode 1107*b*, and is small on the far side from the electrode 1107*b*. This makes the film thickness of the upper protection layer 1107*a* uneven as shown in FIG. 6B. Therefore, thermal conduction becomes uneven depending upon a location of the electrothermal conversion element 1117 when the heat generated by the electrothermal conversion element 1117 is transferred to the ink. This uneven heat conduction may affect ink foaming and the discharge characteristics.

The present invention is directed to decreasing the difference in a dissolution amount due to a location of an upper protection layer and to preventing the film thickness of the upper protection layer from becoming uneven when removing kogation on the upper protection layer by eluting the upper protection layer into liquid.

Various exemplary embodiments, features, and aspects of the invention will be described in detail below with reference to the drawings.

(Liquid Discharge Device)

Figure 1:
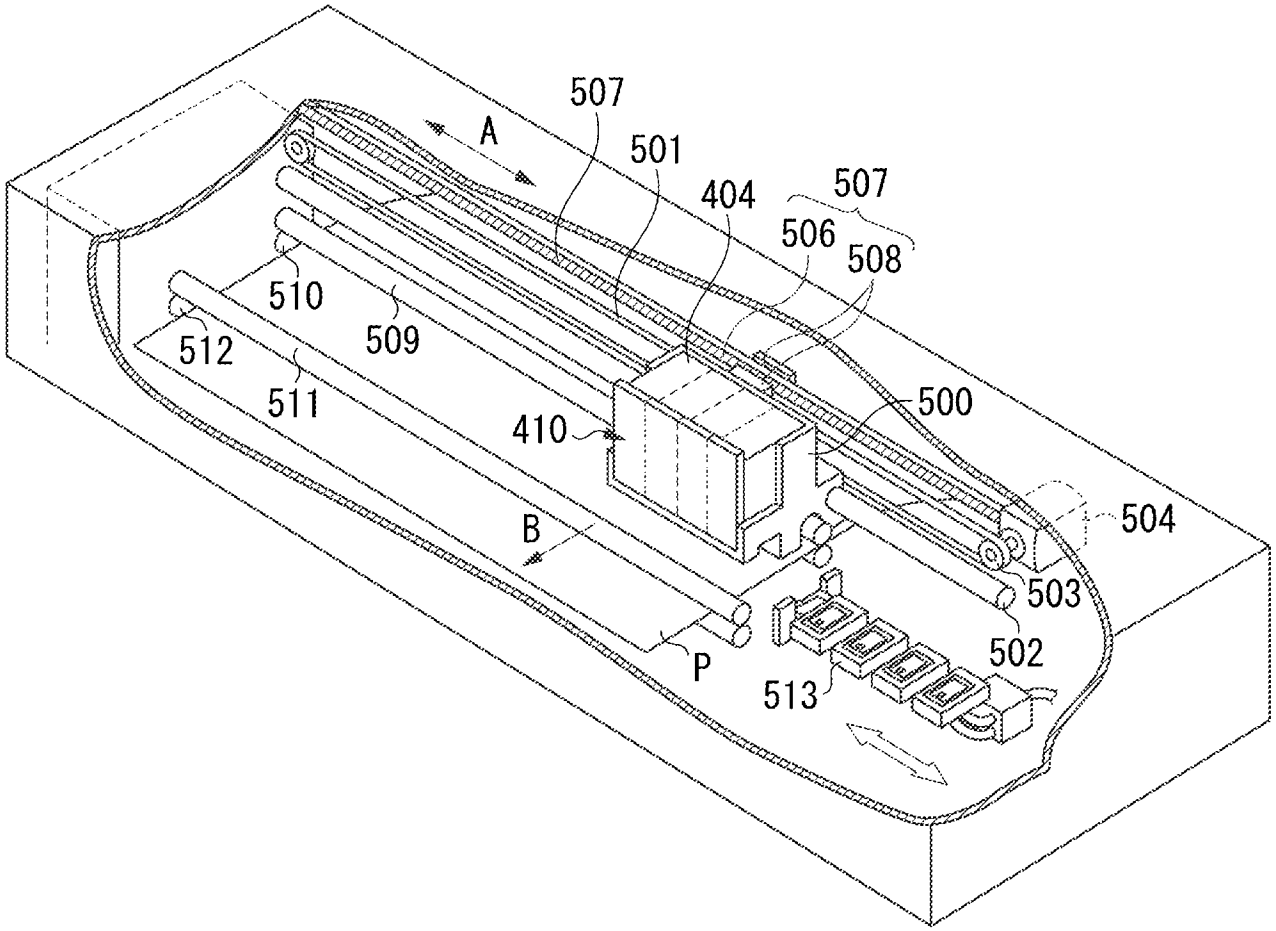
FIG. 1 is a perspective view of an inkjet recording device according to an exemplary embodiment of the present invention.

FIG. 1 illustrates a schematic perspective view of an inkjet recording device as a liquid discharge device according to an exemplary embodiment of the present invention. A carriage 500 is supported by a guide 502 to perform printing with an inkjet head unit 410 installed. The guide 502, which is attached to a chassis, supports and guides the carriage 500 so that the carriage 500 performs reciprocal scanning in a direction at a right angle with the conveyance direction of a recording medium. The guide 502, which is integrated with the chassis, holds the trailing edge of the carriage 500 to maintain the clearance between the inkjet head unit 410 and a recording medium.

The carriage 500 is driven by a carriage motor 504, which is attached to the chassis, via a timing belt 501. The timing belt 501 is stretched and supported by an idle pulley 503.

When forming an image on a recording medium with the configuration described above, the image is positioned as follows. With respect to the row position, a roller pair (not-illustrated) including a conveyance roller and a pinch roller conveys the recording medium to perform positioning. With respect to the column position, the carriage motor 504 moves the carriage 500 in a direction vertical to the conveyance direction described above to arrange the inkjet head unit 410 in a target position for image formation. The inkjet head unit 410, which is once positioned, discharges ink on the recording medium. At the former recording main scanning, the carriage 500 performs scanning in the column direction while recording on the recording medium by the inkjet head unit 410. At the latter sub-scanning, a conveyance roller 511 conveys the recording medium in the row direction. The recording device according to the present exemplary embodiment is configured to repeat the recording main scanning and the sub-scanning alternately to form an image on the recording medium.

(Liquid Discharge Head Unit and Liquid Discharge Head)

Figure 2:
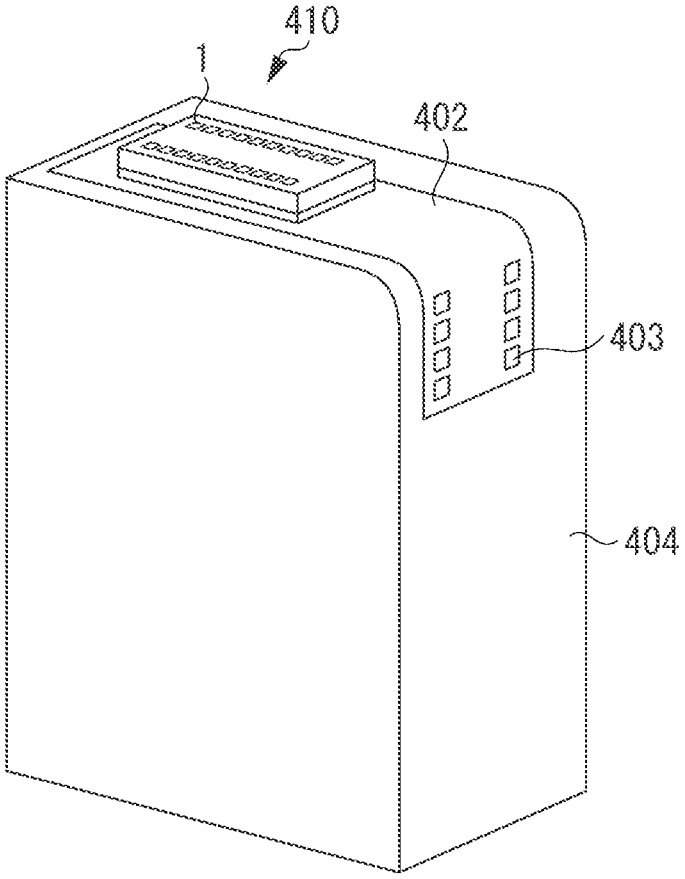
FIG. 2 is a perspective view of an inkjet head unit according to the exemplary embodiment of the present invention.

FIG. 2 is a perspective view illustrating the inkjet head unit 410 as a liquid discharge head unit according to the present exemplary embodiment. The inkjet head unit 410 includes an inkjet head 1, an electric wiring tape 402, and a contact part 403 used to connect electrically to the inkjet recording device (recording device main body).

Figure 3:
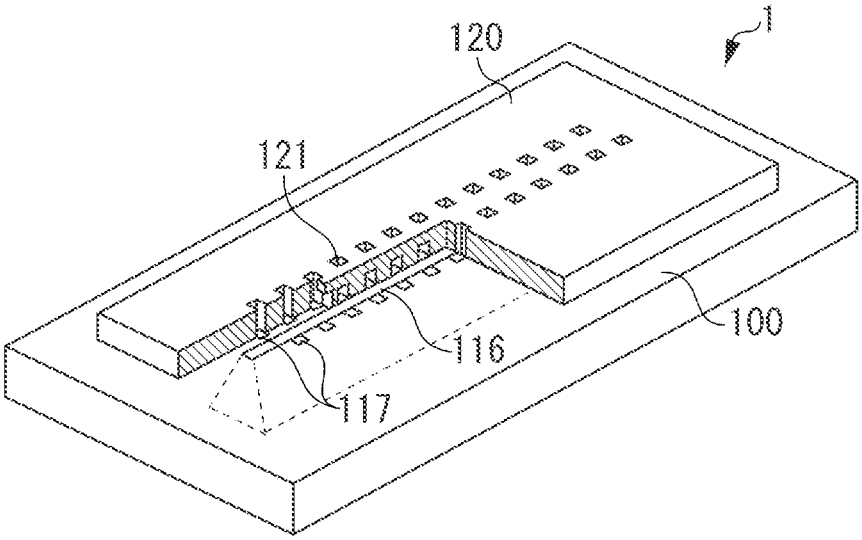
FIG. 3 is a perspective view of an inkjet head according to the exemplary embodiment of the present invention.

FIG. 3 is a perspective view illustrating the inkjet head 1 as a liquid discharge head according to the present exemplary embodiment. The inkjet head 1 includes an inkjet head substrate 100 as a liquid discharge head substrate and a discharge port forming member 120.

On the inkjet head substrate 100, an electrothermal conversion element 117, which generates energy for foaming the ink, and a driving circuit that drives the electrothermal conversion element 117 are formed. In addition, an ink supply port 116 for supplying the ink to heat-acting unit 108 (FIG. 4B) is also formed on the inkjet head substrate 100. The heat-acting unit 108 is a contact portion with the ink above the electrothermal conversion element 117.

In the discharge port forming member 120 made of a resin material, ink discharge ports 121 are formed for discharging the ink, which is supplied from the ink supply port 116. The discharge port forming member 120 is provided on the inkjet head substrate 100 so that each of the ink discharge ports 121 corresponds to each of the electrothermal conversion elements 117. The electrothermal conversion element 117 is selectively driven to cause the ink to foam and, the ink is discharged for recording by using pressure.

Figure 4A:
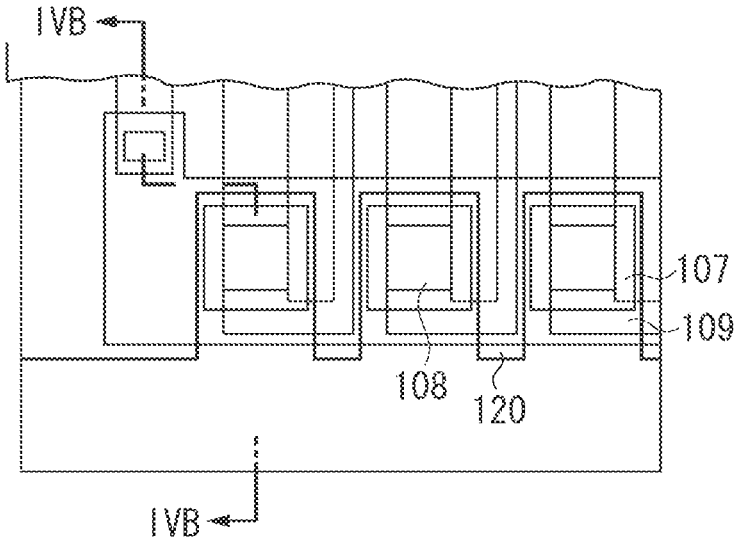
Figure 4B:
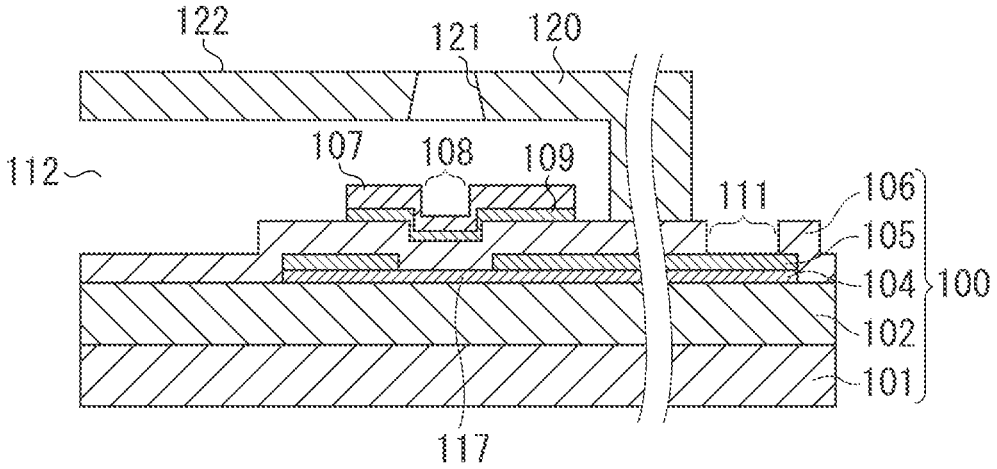

FIGS. 4A and 4B are diagrams illustrating the vicinity of the heat-acting unit 108 of the inkjet head 1 according to the present exemplary embodiment. FIG. 4A is a plan view, and FIG. 4B is a schematic cross sectional diagram taken along IVB-IVB illustrated in FIG. 4A.

The inkjet head substrate 100 includes a silicon substrate 101, a heat accumulation layer 102, a heating resistor layer 104, an electrode wiring layer 105, and an insulating protection layer (insulating film) 106. The heat accumulation layer 102 is made of a thermal oxide film, an SiO film, and an SiN film. The heating resistor layer 104 is made of TaSiN. The electrode wiring layer 105 is as a layer for wiring made of metal material such as Al, Al—Si, and Al—Cu. The electrothermal conversion element 117 is formed by removing a part of the electrode wiring layer 105 to form a gap for exposing the corresponding part of the heating resistor layer 104. The insulating protection layer 106 is provided as a layer above the electrothermal conversion element 117 and the electrode wiring layer 105. The insulating protection layer 106 is made of an SiO film or a SiN film.

An upper protection layer (protection film) 107 protects the electrothermal conversion element 117 against a physical action, such as an impact by cavitation in which the ink is foamed or reduced, and a chemical action caused by the ink. The upper protection layer 107, which is positioned above the electrothermal conversion element 117, is exposed in an ink flow path 112. The exposed part is the heat-acting unit 108 that transfers the heat, which is generated by the electrothermal conversion element 117, to the ink.

According to the present exemplary embodiment, a metal that is eluted in the ink by an electrochemical reaction is used as the upper protection layer 107 that contacts the ink. More specifically, iridium (Ir) is used. The upper protection layer 107 made of Ir has low adhesiveness to the insulating protection layer 106. Therefore, an adhesive layer 109 made of Ta is formed as an intermediate layer between the insulating protection layer 106 and the upper protection layer 107. The adhesive layer 109 increases adhesiveness between the insulating protection layer 106 and the upper protection layer 107.

The adhesive layer 109, which configures a wiring unit for electrically connecting the upper protection layer 107 and an external terminal, is formed using a conductive material. The adhesive layer 109 is inserted into the through-hole, which is formed on the insulating protection layer 106, to connect to the electrode wiring layer 105. In addition, the electrode wiring layer 105 is extended to the end of the silicon substrate 101, and the leading end of the electrode wiring layer 105 forms an external electrode 111 for electrically connecting to an external terminal. This configuration allows the upper protection layer 107 to connect electrically to an external terminal.

According to the present exemplary embodiment, the term "above" in the description of the inkjet head substrate 100 indicates the heat-acting unit 108 side that contacts the ink in the inkjet head substrate 100.

(Cleaning Mechanism of Liquid Discharge Device)

Figure 5:
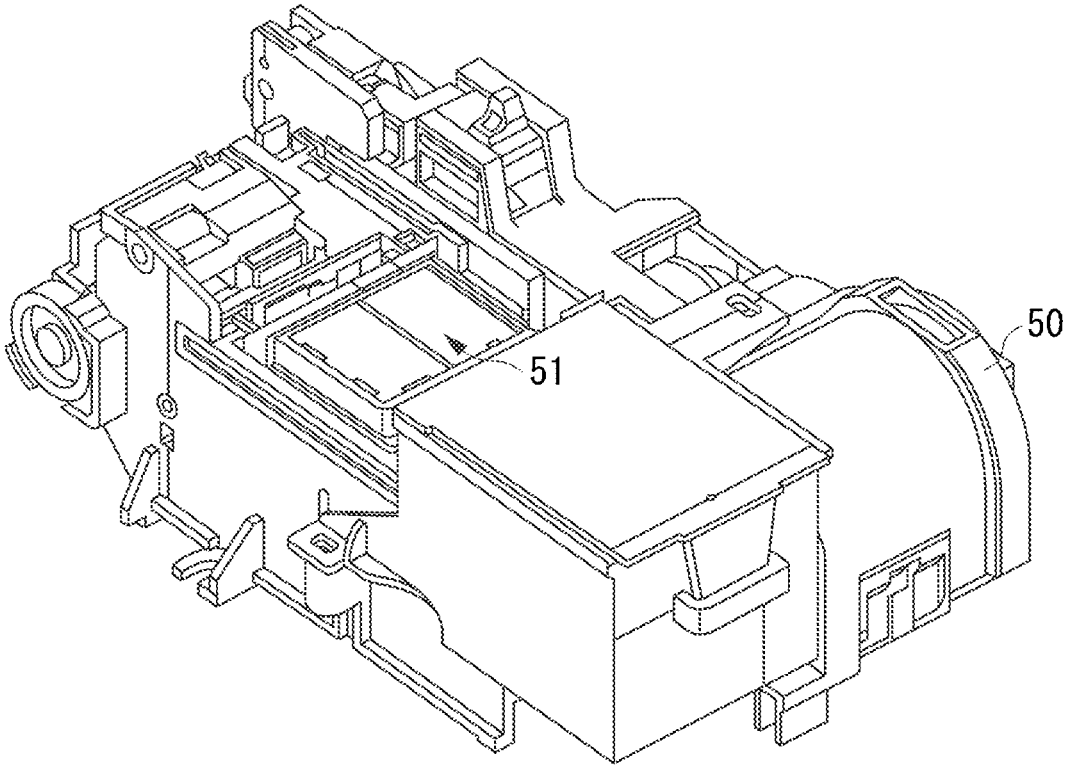
FIG. 5 is a perspective view illustrating a cleaning mechanism of a main body of the inkjet recording device according to the exemplary embodiment of the present invention.

FIG. 5 is a perspective view illustrating the cleaning mechanism provided in the main body of the inkjet recording device according to the present exemplary embodiment.

The cleaning mechanism is for cleaning the inkjet head 1 that includes a pump 50 and a cap 51. The pump 50 is a suction unit for suctioning ink from the inkjet head 1. The cap 51 prevents the inkjet head 1 from being dried. The cap 51 is driven elevatably via an elevating mechanism (not-illustrated). At an elevated position, the cap 51 covers a discharge port surface 122 of the inkjet head 1 to protect the discharge port surface 122 and to perform suction recovery at a non-recording operation. At a recording operation, the cap 51 is set to a lowered position to avoid interference with the inkjet head 1. At the position opposed to the inkjet head 1, the cap 51 can receive preliminary discharge.

In the example illustrated in FIG. 5, the cap 51 is provided in a pair. The suction pump 50 can generate a negative pressure by causing the cap 51 to contact the discharge port surface 122 to form an enclosed space. The negative pressure allows ink to be filled from the ink tank into the inkjet head 1. The negative pressure also allows dust, sticking matters, and bubbles, which are present in the ink discharge ports 121 and ink flow path 112, to be suctioned and removed.

(Kogation Removal Operation and Configuration of Electrode in Cap)

Figure 7A:
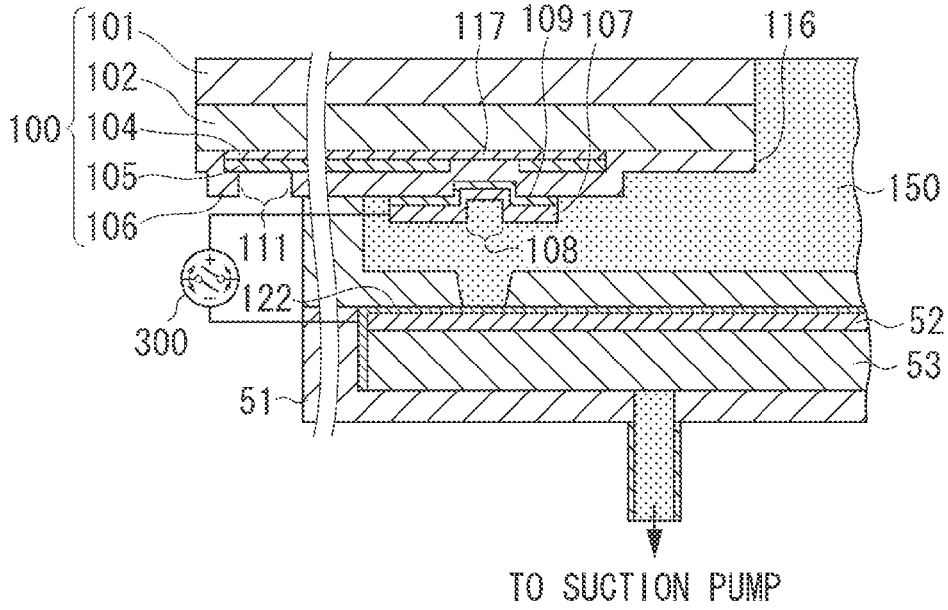
FIGS. 7A, 7B, and 7C are schematic cross section diagrams illustrating examples of an electrode arrangement of the inkjet recording device according to the exemplary embodiment of the present invention.
Figure 7B:
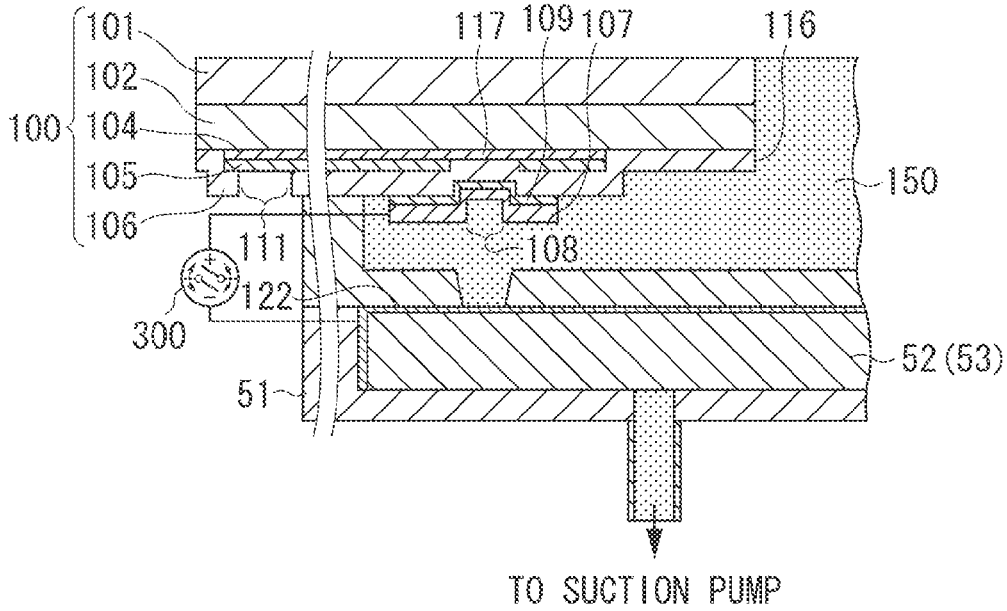
Figure 7C:
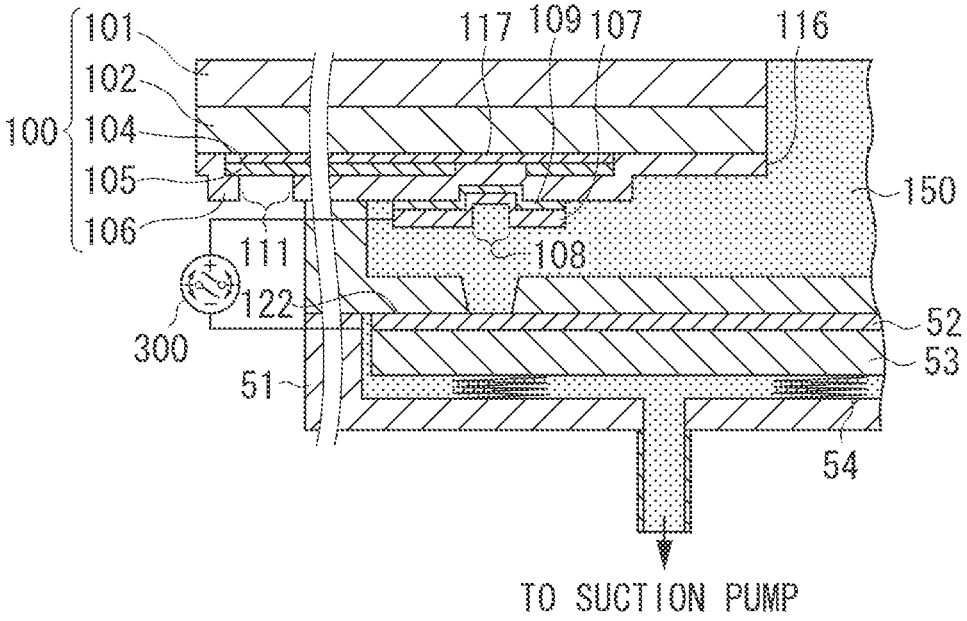

FIGS. 7A to 7C are schematic cross sectional diagrams illustrating configuration examples of the electrode in the inkjet recording device according to the present exemplary embodiment.

According to the present exemplary embodiment, a metal layer as an electrode 52 is formed in the cap 51 of the cleaning mechanism. The electrode 52 is used at an electrochemical reaction for removing kogation on the heat-acting unit 108. The voltage can be applied between the upper protection layer 107 and the electrode 52.

This electrode 52 is provided at a position opposed to the upper protection layer 107 via the ink discharge ports 121 in a state where the cap 51 covers the discharge port surface 122 of the inkjet head 1. The electrode 52 is arranged along the discharge port surface 122 in a state where the cap 51 covers the discharge port surface 122 of the inkjet head 1.

When the ink is filled between the upper protection layer 107 and the electrode 52 and then a voltage is applied, the above-described configuration makes the field-intensity uniform between the upper protection layer 107 and the electrode 52, and thus variation in the field intensity can be prevented. Therefore, when performing the kogation removal processing, difference in the dissolving amount due to the position of the upper protection layer 107 is reduced, and thus the film thickness of the upper protection layer 107 can be prevented from becoming uneven.

The upper protection layer 107 is connected to a voltage application unit 300, which is provided in the inkjet recording device main body, via the electrode wiring layer 105. The electrode 52 provided in the cap 51 is connected to the voltage application unit 300 via another wiring layer.

The upper protection layer 107 of the inkjet head substrate 100 and the electrode 52 in the cap 51 are not connected electrically. When a voltage is applied between the upper protection layer 107 and the electrode 52 by the voltage application unit 300 with the inkjet head 1 filled with ink 150 containing electrolyte, an electrochemical reaction occurs between the upper protection layer 107 and the ink 150.

At this time, when the upper protection layer 107 is the anode, Ir that is used as the upper protection layer 107 is eluted into the ink 150. Therefore, by applying the voltage by the voltage application unit 300 so that the upper protection layer 107 becomes the anode and the electrode 52 becomes the cathode, the upper protection layer 107 is eluted into the ink to remove kogation on the heat-acting unit 108.

Figure 10A:
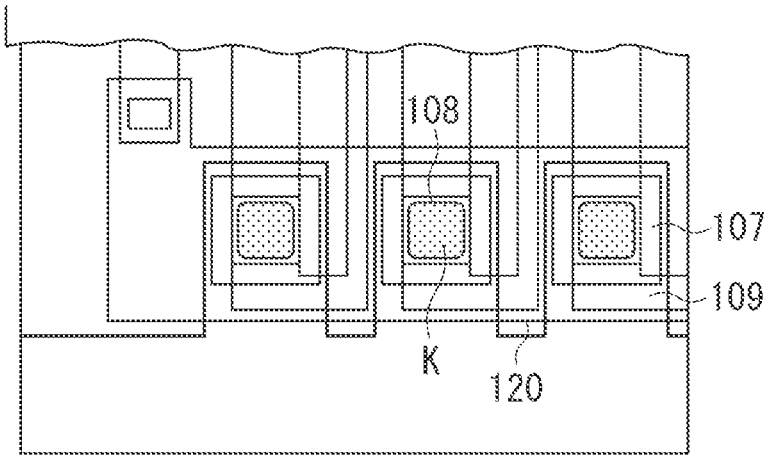
FIGS. 10A and 10B are diagrams illustrating the states of kogation deposited on a heat-acting unit, and the state in which the kogation has been removed, respectively.
Figure 10B:
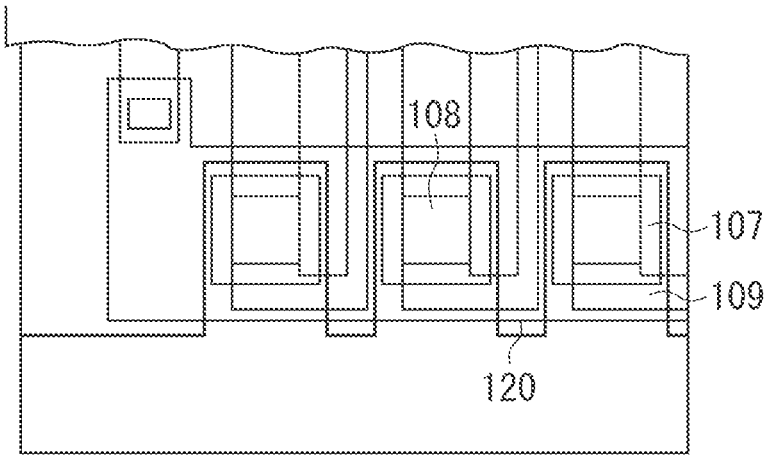

FIG. 10A is a diagram illustrating the state of kogation K deposited on the heat-acting unit 108. FIG. 10B is a diagram illustrating the state in which the kogation has been removed.

Because ink compounds are easy to adhere as kogation to the surface of the upper protection layer 107 on the electrothermal conversion element 117 that becomes high temperature at recording, kogation will be deposited on the surface of the heat-acting unit 108 as the electrothermal conversion element 117 is driven. The kogation adhered in this way can be removed by eluting the upper protection layer 107 into the ink by the electrochemical reaction as described above.

According to the present exemplary embodiment, the voltage may be applied evenly to the heat-acting unit 108 because the upper protection layer 107 is formed using Ir that does not form an oxide film up to 800° C. in the atmosphere.

According to the present exemplary embodiment, Ir, which has a property of eluting in an electrolyte with a relatively low pH, is used as the upper protection layer 107. However, the material of the upper protection layer 107 is not limited to Ir. Any material that contains a metal, which is eluted by an electrochemical reaction, and that does not form an oxide film that prevents elution by heating. Other materials such as ruthenium (Ru) may also be used. A material, which does not form an oxide film that prevents elution by heating, does not mean that any oxide film will not be formed. Even when an oxide film is formed by heating, a material that the oxide film is formed to such a degree that the elution is not prevented is included.

Next, the configuration of the electrode 52 is described more in detail below with reference to FIGS. 7A to 7C.

In FIG. 7A, the porous electrode 52 made of Ir is formed on the surface of an absorber 53 made of porous polyolefin provided in the cap 51. Since a film of the electrode 52 is so thin that the film does not affect permeability and transparency of the ink, the cap 51 can be filled with the ink by suctioning the ink. Therefore, applying a voltage between the upper protection layer 107 of the inkjet head 1 and the electrode 52 provided on the surface of the absorber 53 can cause an electrochemical reaction between the ink and the upper protection layer 107.

FIG. 7B is a diagram illustrating the configuration in which the absorber 53, which is provided in the cap 51, is formed using a non-oxide conductive ceramic porous material, such as a carbide, a boride, or a nitride. The absorber 53 itself is used as the electrode 52.

FIG. 7C is a diagram illustrating the configuration in which the configuration of the absorber 53 and the electrode 52 is similar to the configuration illustrated in FIG. 7A, but an elastic body 54 such as a spring is provided under the absorber 53. The elastic body 54 generates elastic force so that the electrode 52 urges the discharge port surface 122 of the inkjet head 1 with the discharge port surface 122 being covered by the cap 51. With the above-described configuration, the distance between the upper protection layer 107 and the electrode 52 is maintained close, and an electrochemical reaction can be occurred effectively.

In the configurations illustrated in FIGS. 7A to 7C, the electrode 52 is provided on the surface of the absorber 53 on the discharge port surface 122 side. The configuration allows the electrode 52 to be arranged near to the upper protection layer 107. Instead of this configuration, the electrode 52 may also be provided on the surface of the absorber 53 on the side opposite to the discharge port surface 122. In this case, the electrode 52 may not be a porous material.

(Kogation Removal Processing Flow)

Figure 8A:
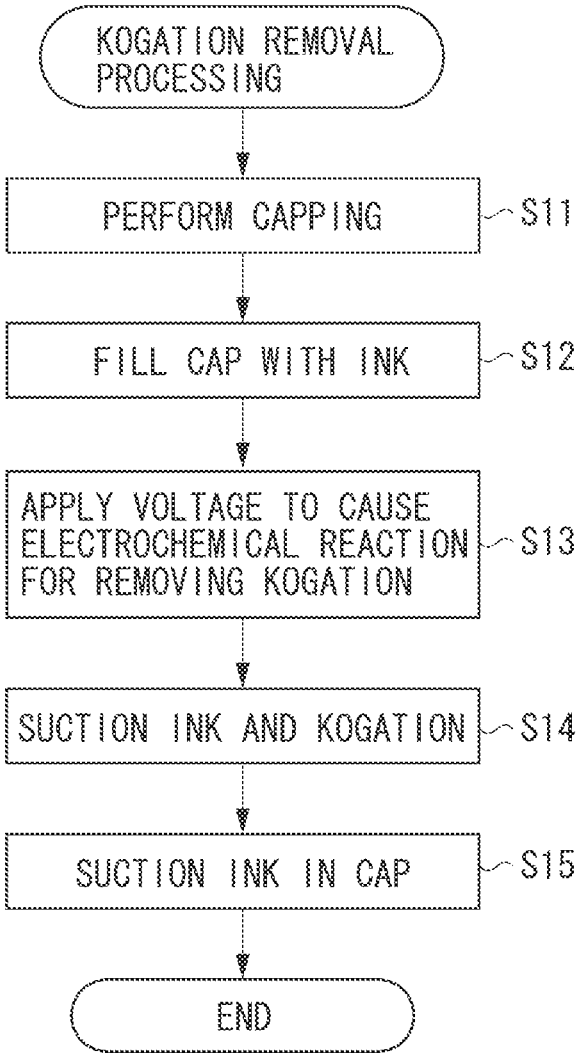
FIGS. 8A, 8B, and 8C are flowcharts illustrating an example of a kogation removal processing procedure.
Figure 8B:
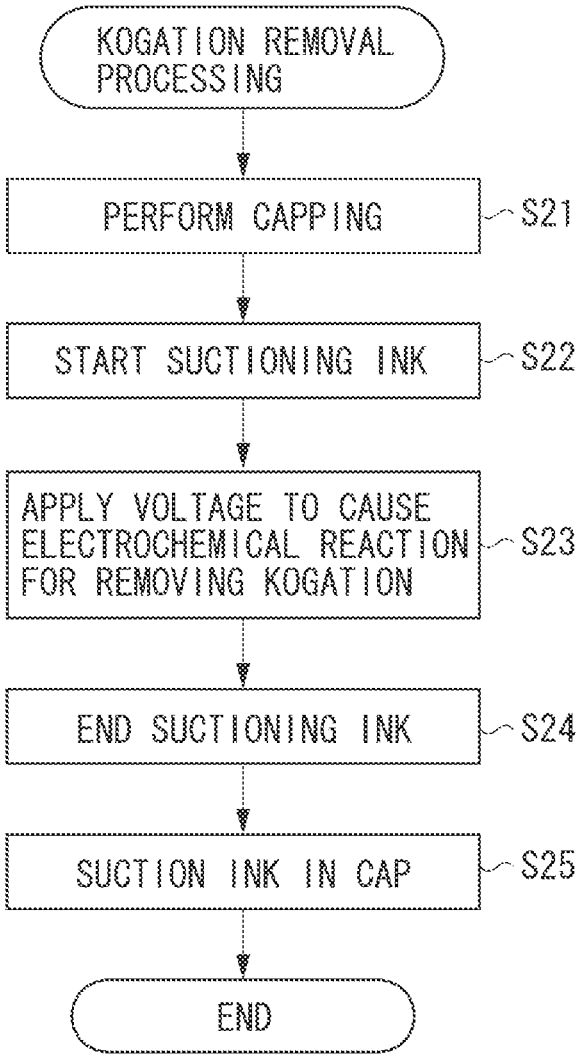
Figure 8C:
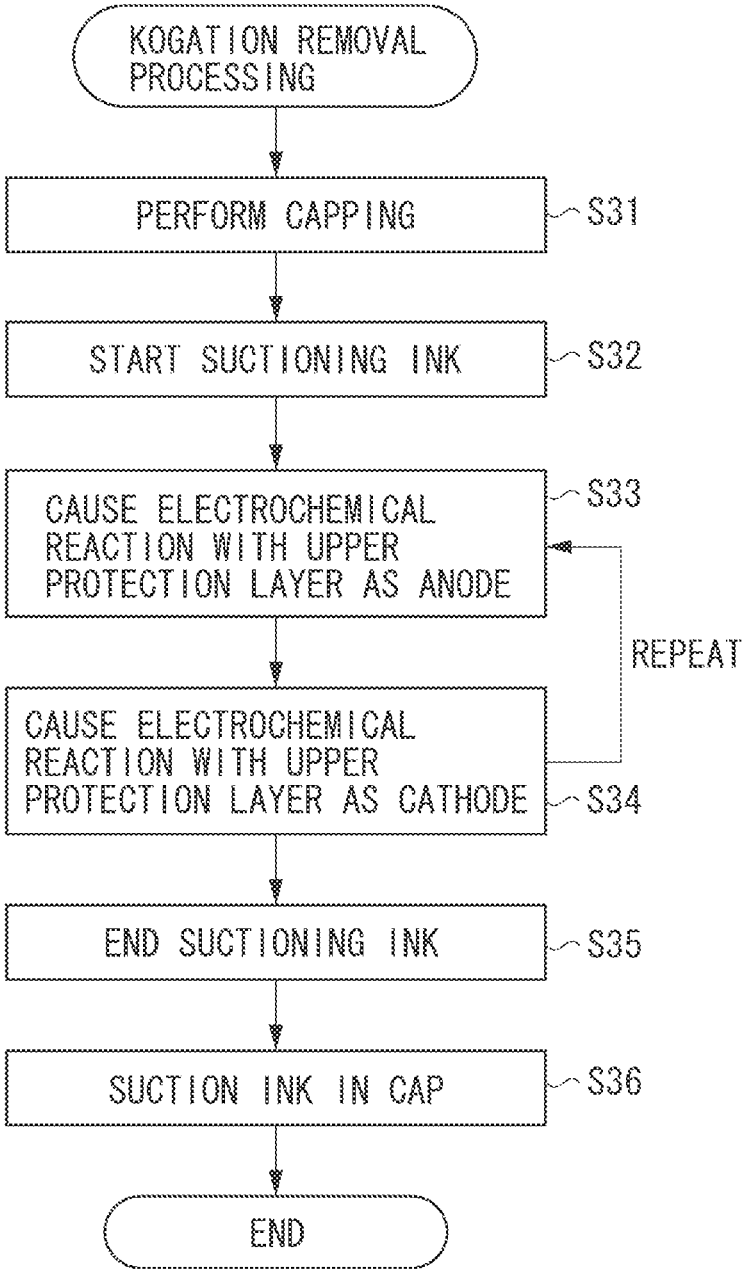
Figure 9A:
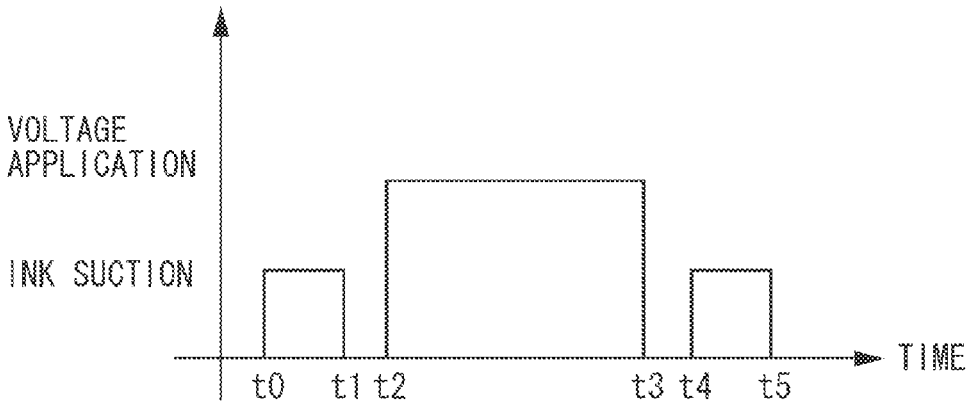
FIGS. 9A, 9B, and 9C, which correspond to FIGS. 8A, 8B, and 8C respectively, are diagrams illustrating timing of voltage application and ink suctioning operation to an upper protection layer.
Figure 9B:
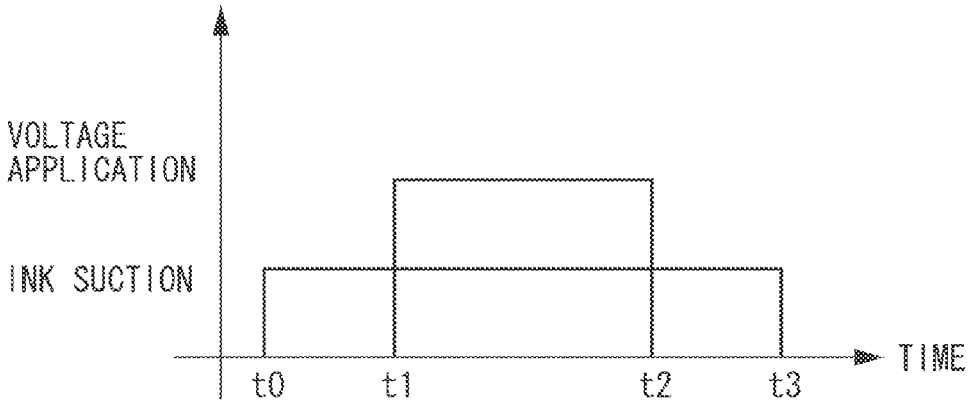
Figure 9C:
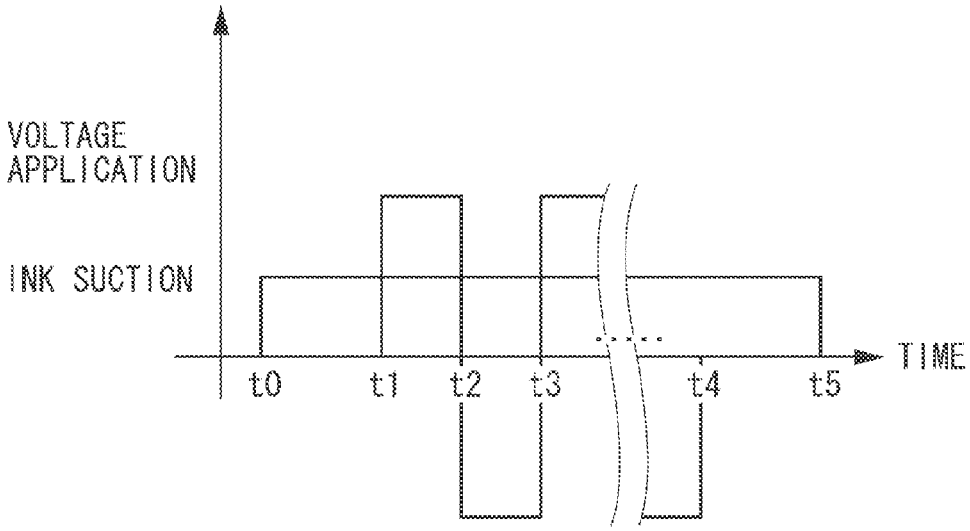

Examples of a kogation removal processing procedure are described below with reference to FIGS. 8A to 8C and FIGS. 9A to 9C. FIGS. 8A to 8C are flowcharts illustrating examples of the kogation removal processing procedure performed by the inkjet recording device according to the present exemplary embodiment. FIGS. 9A to 9C are timing diagrams illustrating the voltage application and the ink suction recovery processing for the upper protection layer 107. FIGS. 9A to 9C correspond to FIGS. 8A to 8C, respectively.

In step S11 in the example illustrated in FIG. 8A and FIG. 9A, the inkjet recording device performs capping, in which the inkjet head 1 is covered by the cap 51 to remove kogation deposited on the heat-acting unit 108 of the inkjet head 1. In step S12, with the inkjet head 1 covered by the cap 51, the inkjet recording device actuates the suction pump 50 to suction the ink. As a result, the ink is filled between the upper protection layer 107 of the inkjet head 1 and the electrode 52, which is arranged in the cap 51, to establish electrical continuity (t=t0 to t1).

After that, the inkjet recording device stops suctioning the ink. In step S13, the voltage application unit 300 applies the voltage (t=t2 to t3) so that the upper protection layer 107 becomes the anode and the electrode 52 becomes the cathode. Applying the voltage in this way causes the upper protection layer 107 to be eluted into the ink to remove deposited kogation from the surface of the heat-acting unit 108.

After that, in step S14, the inkjet recording device actuates the suction pump 50 again to suction the kogation, which is removed from the heat-acting unit 108, as well as the ink, and discharges the kogation and the ink from the inkjet head 1 (t=t4 to t5). In step S15, the inkjet recording device suctions the ink in the cap 51 (not-illustrated in FIG. 9A) and a sequence of the kogation removal processing is completed.

With the above-described method, suctioning of the ink does not performed while the voltage is applied. Therefore, the ink consumption can be reduced.

In the example illustrated in FIG. 8B and FIG. 9B, the inkjet recording device performs capping in step S21, starts suctioning the ink in step S22 (t=t0), and fills the space between the upper protection layer 107 and the electrode 52 with the ink to establish electrical continuity. The operation is similar to the operation illustrated in FIG. 8A and FIG. 9A.

The inkjet recording device continues suctioning the ink even after the space between the electrodes is filled with the ink. In step S23, the voltage application unit 300 applies the voltage so that the upper protection layer 107 becomes the anode and the electrode 52 becomes the cathode (t=t1 to t2). Applying the voltage in this way causes the upper protection layer 107 to be eluted into the ink to remove deposited kogation from the surface of the heat-acting unit 108, and the inkjet recording device suctions the kogation as well as the ink to discharge the kogation and the ink from the inkjet head 1. After that, in step S24, the inkjet recording device stops suctioning the ink from the inkjet head 1 (t=t3). In step S25, the inkjet recording device suctions the ink filled in the cap (not-illustrated in FIG. 9B) and a sequence of the kogation removal processing is completed.

The electrochemical reaction may be inhibited by the bubbles that are generated from the anode side when the ink is decomposed at an electrochemical reaction, and the elution of the upper protection layer 107 may become difficult to proceed. By performing the electrochemical reaction while suctioning the ink as described above, bubbles are removed forcibly and new ink is introduced between the electrodes to allow the electrochemical reaction to proceed even if bubbles are generated.

The example illustrated in FIG. 8C and FIG. 9C is similar to the example illustrated in FIG. 8B and FIG. 9B in that, in steps S31 to S34, the inkjet recording device performs capping for the inkjet head 1 and then causes an electrochemical reaction by applying the voltage while continuing the ink suction. In step S33, the voltage application unit 300 applies the voltage so that the upper protection layer 107 of the inkjet head 1 becomes the anode and the electrode 52 in the cap 51 becomes the cathode. After that, in step S34, the polarities of both the electrodes are inverted to cause the upper protection layer 107 to be the cathode and the electrode 52 to be the anode. In addition, the inkjet recording device repeats steps S33 and step S34.

When the inkjet recording device continues the electrochemical reaction using resin dispersion-type pigment ink as the ink with the upper protection layer 107 as the anode and with the electrode 52 as the cathode, the ink components gradually adhere to the surface of the upper protection layer 107 as the anode side. When the ink components cover the all of the upper protection layer 107, the electrochemical reaction with the ink may be stopped.

As described above, the ink components adhered to the surface of the electrodes are removed and dispersed by inverting the polarities of both the electrodes by a voltage inverting circuit, and thus all the surface of the upper protection layer 107 is prevented from being covered by the ink components. Applying the voltage with the upper protection layer 107 as to be the anode again causes the upper protection layer 107 to be eluted, and a kogation on the heat-acting unit 108 can be removed continuously. By repeating the operation described above, the inkjet recording device can remove kogation deposited on the upper protection layer 107. Step S35 and step S36 are similar to step S24 and step S25 illustrated in FIG. 8B.

Although the kogation removal processing according to the present exemplary embodiment, which is performed with filling the inkjet head with ink, has been described above, kogation-removing liquid containing an electrolyte may also be used instead of the ink.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-018510 filed Feb. 1, 2013, which is hereby incorporated by reference herein in its entirety.

What is claimed is:

1. A liquid discharge device comprising:

a liquid discharge head including a discharge port surface on which discharge ports for discharging liquid are formed, an electrothermal conversion element configured to generate energy for discharging liquid from the discharge ports, and a protection film configured to cover at least the electrothermal conversion element; and a cap configured to cover the discharge port surface, wherein the cap is arranged along the discharge port surface at a position opposite to the protection film via the discharge ports in a state where the cap covers the discharge port surface, and wherein the cap includes an electrode configured to be used to apply voltage between the protection film and the electrode, wherein the liquid discharge device applies voltage between the protection film and the electrode to cause the protection film to be eluted into the liquid in a state where the discharge port surface is covered by the cap and electrical conduction is made between the protection film and the electrode via the liquid.

2. The liquid discharge device according to claim 1, wherein the protection film contains at least one of iridium and ruthenium.

3. The liquid discharge device according to claim 1, wherein the protection film contains a metal that is eluted by an electrochemical reaction with liquid.

4. The liquid discharge device according to claim 1, wherein the liquid discharge head includes an insulation film between the electrothermal conversion element and the protection film.

5. The liquid discharge device according to claim 1, wherein the cap includes a porous absorber inside the cap, and the electrode is provided on a surface of the absorber facing the discharge port surface in a state where the cap covers the discharge port surface.

6. The liquid discharge device according to claim 1, wherein the cap includes a conductive porous absorber inside the cap as the electrode.

7. The liquid discharge device according to claim 1, wherein the cap includes an elastic body that generates elastic force for allowing the electrode to urge the discharge port surface in a state where the cap covers the discharge port surface.

8. The liquid discharge device according to claim 1, further comprising a voltage application unit configured to apply a voltage between the protection film and the electrode.

9. The liquid discharge device according to claim 1, further comprising a suction unit configured to suction liquid from the liquid discharge head via the cap.

10. A cleaning method for the liquid discharge head of the liquid discharge device according to claim 1, the cleaning method comprising applying voltage between the protection film and the electrode to cause the protection film to be eluted into the liquid in a state where the discharge port surface is covered by the cap and electrical conduction is made between the protection film and the electrode via the liquid.

11. The cleaning method for the liquid discharge head according to claim 10, the cleaning method further comprising suctioning the liquid from the liquid discharge head via the cap to make electrical conduction between the protection film and the electrode via the liquid.

12. The cleaning method for the liquid discharge head according to claim 10, the cleaning method further comprising suctioning the liquid from the liquid discharge head via the cap, and discharging the liquid, containing the eluted protection film, from the liquid discharge head.

13. The cleaning method for the liquid discharge head according to claim 12, the cleaning method further comprising discharging the liquid, containing the eluted protection film, while applying voltage between the protection film and the electrode.

14. The cleaning method for the liquid discharge head according to claim 10, the cleaning method further comprising applying voltage while inverting polarities of the protection film and the electrode.

* * * * *